US005248399A

United States Patent [19]

Meguro et al.

[11] Patent Number: 5,248,399

[45] Date of Patent: Sep. 28, 1993

[54] METHOD OF REGENERATING ALUMINUM SURFACE CLEANING AGENT

[75] Inventors: Shigeyuki Meguro; Kiyotada Yasuhara, both of Yokohama, Japan

[73] Assignee: Nippon Paint Co., Ltd., Osaka, Japan

[21] Appl. No.: 894,756

[22] Filed: Jun. 5, 1992

[30] Foreign Application Priority Data

Jun. 7, 1991 [JP] Japan ..... 3-162374

[51] Int. Cl.[5] ..... C25B 1/00

[52] U.S. Cl. ..... 204/130

[58] Field of Search ..... 204/130

[56] References Cited

U.S. PATENT DOCUMENTS 5,035,778 7/1991 Bindra ..... 204/130

*Primary Examiner*—T. M. Tufariello

*Attorney, Agent, or Firm*—Sughrue, Mion, Zinn, Macpeak & Seas

[57] ABSTRACT

A cleaning agent is used to wash surfaces of aluminum products in a cleaning bath. The cleaning agent is a water-soluble acid containing ferric ions. During the cleaning process, the ferric ions are reduced to ferrous ions. The used cleaning agent is sent to an electrolytic tank so that the ferrous ions are subject to the electrolytic oxidation to be converted into ferric ions. The regenerated cleaning agent is returned to the cleaning bath.

8 Claims, 1 Drawing Sheet

METHOD OF REGENERATING ALUMINUM SURFACE CLEANING AGENT

BACKGROUND OF THE INVENTION

1. Field of the Invention

This invention relates to a method of regenerating an aluminum surface cleaning agent which is used in an aluminum surface cleaning bath, and more particularly to stably and effectively regenerate the aluminum surface cleaning agent which is used to remove lubricating oil and aluminum powder (smut) from the surface of aluminum or aluminum alloy products.

2. Description of the Related Art

Products with aluminum surfaces, e. g., beverage containers made of aluminum or aluminum alloy, are ordinarily manufactured by a molding process known as "drawing and ironing" (hereinafter called "DI process"). During this DI process, lubricating oil is applied to outer surfaces of metal surfaces, and smut tends to adhere to inner surfaces of resulting containers. The surfaces of such containers are usually protected by surface treatment, conversion coating or painting, for example. Prior to the surface treatment or conversion coating, the foregoing lubricating oil and smut have to be removed from the metal surface. The aluminum surface is cleaned by the etching process. An acid cleaner is usually used for the surface cleaning so as to assure excellent surface treatment or conversion coating on the aluminum surface.

Conventionally, hydrofluoric acid cleaning agents are used as the acid cleaner as proposed in U.S. Pat. No. 3,728,188 and British Patent No. 1,454,974. These cleaning agents use chromic acid as an inhibiter so as to prevent corrosion of treatment apparatuses such as a surface cleaning bath or pump. However, the chromic acid and fluoride ions are so toxic that a special care should be taken with respect thereto to prevention of pollution of the working environment and disposal of used cleaning agents. Unfortunately, there is the problem that if the cleaning agent is free from the chromic acid, treatment apparatuses may be corroded. Further, if the fluoride ions are decreased, there is another problem that the cleaning agent suffers from lessened cleaning power.

In U.S. Pat. No. 4,728,456, a cleaner with a small quantity of or free from fluoride ions is proposed which can assure excellent cleaning power.

This cleaner contains 0.2–4 g/l ferric ions, but does not contain any chromium ion. The cleaner has its pH regulated to 0.6–2.0 with sulfuric acid and/or nitric acid. In the cited invention, the cleaner also contains 0.001–0.5 g/l fluoride ions. With this cleaner, it is considered that the etching of the aluminum surface by sulfuric acid and nitric acid is promoted by ferric ions ($Fe^{3+}$). The promotion mechanism thereof is suspected to be due to a cathode reaction $Fe^{3+}+e^{-}\rightarrow Fe^{2+}$.

The foregoing reaction consumes ferric ions in the cleaning bath. Therefore, it is necessary to replenish the ferric ions to the cleaning bath so as to restore and maintain the predetermined amount of the ferric ions. On the contrary, ferrous ions ($Fe^{2+}$) will be gradually produced along with the cathode reaction of the ferric ions. The ferrous ions do not contribute to promotion of the etching. When the ferrous ions accumulate in large quantity, they produce a precipitate which makes the cleaning bath muddy, and reduces the cleaning power of the bath.

U.S. Pat. No. 4,851,148 proposes a method of solving the foregoing problems caused by generation and build-up of ferrous ions in the cleaning bath. Specifically, it is proposed to replenish aqueous iron compound solutions into the cleaning bath so as to compensate for consumed ferrous ions and an oxidizing agent so as to oxidize ferrous ion. Further, the amount of the ferric ions can be controlled in the cleaning bath by maintaining a predetermined oxidation reduction potential.

In the last mentioned invention, hydrogen peroxide is used as an oxidizing agent. However, when a strong hyrogen peroxide is supplied in the cleaning bath, the cleaning agent would splash. This is because an abrupt oxidation is caused by a small amount of metal salt mixed into the hydrogen perioxide.

DETAILED DESCRIPTION OF THE INVENTION

With the foregoing problems of the prior art in mind, it is an object of this invention to provide a method of stably and efficiently regenerating an aluminum surface cleaning bath.

According to the invention, there is provided a method of regenerating an aluminum surface cleaning agent, comprising: cleaning surfaces of aluminum, which includes aluminum alloy, with the cleaning agent composed of an aqueous acid solution, circulating the cleaning agent through an electrolytic bath, and oxidizing ferrous ions into ferric ions by an electrolytic oxidation process so as to regenerate ferric ions in the cleaning bath.

It is preferable that the cleaning agent in the cleaning bath contains 0.2–4 g/l ferric ions but does not contain any chromium ions, and has its pH value regulated to 0.6–2.0 by sulfuric acid and/or nitric acid.

The ferric ions will be obtained from water-soluble ferric salts such as $Fe_2(SO_4)_3$, $Fe(NO_3)_3$, and $Fe(ClO_4)_3$. It should be noted that the chromiumcontaining salts such as $Fe_2(CrO_4)_3$ and $(NH_4)Fe(CrO_4)_2$ must not be used. When the cleaning agent contains a very small amount of the ferric ions, the etching process will be too slow to clean the surface satisfacatorily. On the other hand, too many ferric ions will adversely affect the etching rate. When fluoride ions are also used, their etching power would be suppressed by the ferric ions, thereby preventing satisfacatory surface cleaning.

The term "chromium ions" represents not only hexavalent chromium ions proper but also trivalent chromium ions and complex salts containing such ions, (e.g., complex ions $[Cr(OH_2)_5]^{3+}$) obtained from various chromium compounds (e.g., $[Cr(OH_2)_5]Cl_3$).

It is necessary that the cleaning agent in the cleaning bath should have the specified pH. If the pH of the cleaning bath is higher than the foregoing preferable range, the rate of etching the aluminum is reduced too much to assure satisfactory surface cleaning. On the contrary, it is not required to regulate the lower limit of the pH. However, a pH below 0.6 does not to improve the cleaning performance. It is not advantageous to operate the cleaning bath below pH 0.6. In addition, the more acidic the cleaning agent, the more likely the cleaning bath, pumps and so on would be corroded. The pH of the cleaning agent is regulated by applying sulfuric acid and/or nitric acid. It is more preferable to use the sulfuric acid since the nitric acid might evolve decomposition gases (e.g., NO and $N_2O_4$) during the surface cleaning process.

Use of strong acid other than the sulfuric acid and nitric acid, e.g. hydrochloric acid, to regulate the pH value of the cleaning agent would lead to pitting on the aluminum surface in the presence of the ferric ions. Such pitting not only impairs the external appearance of the aluminum products but also causes edge splitting during a metal working process. Use of phosphoric acid would greatly reduce the etching rate. Although such acids are not desirable, they may be used together with the foregoing sulfuric acid and/or nitric acid so long as the surface cleaning performance is not adversely affected.

It is advantageous that the cleaning agent contains a surface active agent, which usually has a concentration of 0.1–10 g/l, and preferably 0.5–4 g/l as with conventional cleaning agents. Such surface active agent enhances removal of the lubricating oil or smut. The surface active agent may be any of nonionic, cationic, anionic or amphoteric types.

The cleaning agent desirably includes a chelating agents such as citric acid, oxalic acid or tartaric acid, which accelerate the etching process to improve the appearance of the treated article.

According to the invention, the cleaning agent is applied to the surface to be cleaned by spraying or immersion in a manner similar to that of the prior art practice. The cleaning agent may be applied within a wide temperature range between room temperature and 80° C., and preferably in the range between 50° C. and 70° C. The period of cleaning depends upon the foregoing application temperature, the manner of application, and the degree of contamination of the article to be treated. The surface cleaning should be carried out within a period of 10 to 120 seconds.

When aluminum articles are being washed by the cleaning agent, the ferric ion concentration is lowered. In addition, the ferric ions would be reduced to ferrous ions. According to the embodiment, the ferrous ions in the cleaning agent are subject to the electrolytic oxidation and converted into ferric ions, thereby restoring and maintaining the specified amount of the ferric ions.

As the ferric ion concentration decreases, water soluble iron compounds are supplied to the cleaning bath so as to restore and maintain the predetermined amount of iron ions. In such a case, also other necessities such as ferric sulfate and ferric nitrate are supplied to the cleaning bath so as to replenish the sulfuric acid and nitric acid.

The following requirements should be satisfied to perform the electrolytic oxidation according to the invention. "dm" is equivalent to 10 cm in the following description.

(1) A current density (A/electrode area) is in a range between 0.1 and 30A/dm$^2$, and more preferably between 1 to 15A/dm$^2$. When the current density is less than 0.1, the oxidation rate would be lowered and a large electrode area would be required. This leads to the necessity of a large and expensive treatment apparatus. On the contrary, if the current density is larger than 30A/dm$^2$, water would be electrolyzed, thereby reducing the efficiency of electrolysis, which also makes the treatment apparatus larger and more expensive.

(2) A flow rate of the cleaning agent via the pump per unit electrode area is approximately 0.1–5 liters/min.dm$^2$, and preferably 0.5–3 liters/min. dm$^2$. If the flow rate is below 0.1 liter/min. dm$^2$, the oxidizing rate will be reduced. On the contrary, if the flow rate is more than 5 liters/min.dm$^2$, the oxidizing rate will not be improved. In such a case, the pump would become too large and expensive.

(3) A voltage and current to be applied will depend upon the structure of the cleaning bath (electrode area and arrangement).

The concentration of the ferric ions in the cleaning agent can be controlled within the predetermined range by satisfying the foregoing requirements and by applying a well-known oxidation-reduction potential. For instance, the electrolytic oxidation process is continued while maintaining the oxidation-reduction potential of about 550–700 mV (silver—silver chloride electrode potential reference) which is present when the surface cleaning process is started. The oxidation-reduction potential can be controlled according to the concentration of all the iron ions in the cleaning agent.

The pH value of the cleaning agent can be controlled according to a well-known conductometry. In this embodiment, the cleaning agent may be maintained at 20–80mS/cm. Here, 1mS/cm is 1/KΩ.cm. Thus, the ion concentration of the cleaning agent is maintained within the predetermined value. The treatment apparatus can be automated, thereby simplifying the maintenance of the cleaning bath and assuring effective operation of the bath.

As described so far, the method of this invention is advantageous to restore the reduced ferrous ions to ferric ions without using oxidizing agents. The cleaning bath can be reliably maintained, and automated to simplify its maintenance procedure.

DESCRIPTION OF EXAMPLES

Figure 1:
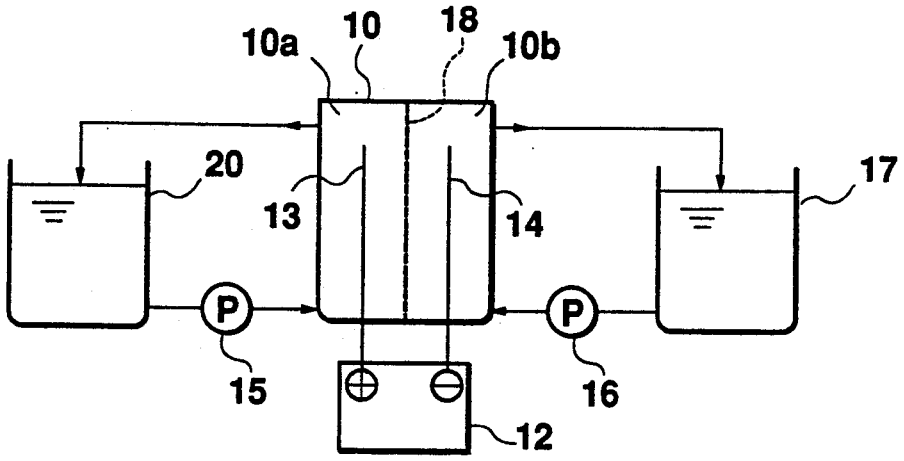
FIG. 1 is a cross-sectional view showing the configuration of a treatment apparatus to which a method according to the invention is applied.
Figure 2:
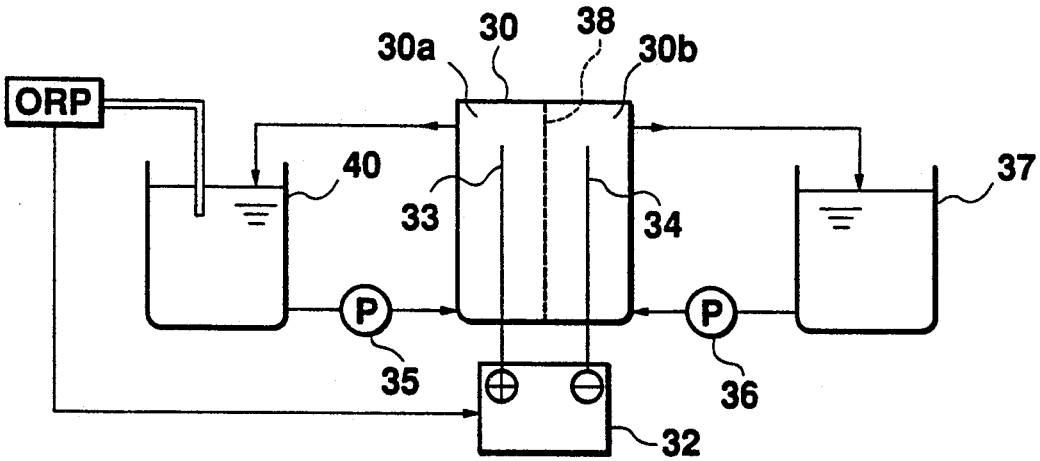
FIG. 2 is a cross-sectional view showing the configuration of another treatment apparatus to which the method of the invention is applied.

The invention will be described with reference to a first example. FIG. 1 of the accompanying drawings shows a configuration of an apparatus to which the present invention is applied. An electrolytic bath 10 has an effective electrode area of 1.8 dm$^2$, and an effective electrode size of 120×150 mm. A DC power source 12 supplies a current to the electrolytic bath 10 so that the electrolysis is executed between an anode 13 and a cathode 14. A cleaning bath 20 houses an aluminum surface cleaning agent. The cleaning agent is conducted to an anode chamber 10*a* of the electrolytic bath 10 via a pump 15. A sulfuric aqueous solution, catholyte, is applied to a cathode chamber 10*b* of the electrolytic bath 10 from a catholyte bath 17 via another pump 16. The electrolytic bath 10 has a partition 18 in its center so as to separate the anolyte and catholyte. Therefore, no iron ions cannot reach the cathode chamber 10*b*.

Table 1 shows the composition of the cleaning agent applied to experiments, and Table 2 shows the electrolysis conditions and results.

TABLE 1

| | Composition of Cleaning Agents | | | | |
|---|---|---|---|---|---|
| | A | B | C | D | E |
| $FeSO_4.7H_2O$ | 7.5 g/l | 15.0 | 1.0 | 20.0 | 7.5 |
| $Fe^{2+}$ | 1.5 | 3.0 | 0.2 | 4.0 | 1.5 |

TABLE 1-continued

| | Composition of Cleaning Agents | | | | |
|---|---|---|---|---|---|
| | A | B | C | D | E |
| $H_2SO_4$ | 12.6 | 9.9 | 4.8 | 28.7 | 0 |
| $HNO_3$ | 1.0 | 1.0 | 1.0 | 1.0 | 1.0 |
| pH of Bath | 0.9 | 1.0 | 0.8 | 0.6 | 2.0 |

TABLE 2

| | Electrolytic Conditions and Results Example (1/2) | | | | | | | |
|---|---|---|---|---|---|---|---|---|
| Sample No. | 1 | 2 | 3 | 4 | 5 | 6 | 7 | 8 |
| Agents | A | B | C | D | E | A | B | C |
| Conditions | | | | | | | | |
| Cur. density A/dm$^2$) | 5 | 5 | 0.1 | 10 | 20 | 30 | 1 | 10 |
| Flow rate (1/min · dm$^2$) | 1 | 1 | 5 | 2 | 1 | 0.1 | | 2 |
| Iron density in anolyte (g/l) | 1.5 | 3.0 | 0.2 | 4.0 | 1.5 | 1.5 | 3.0 | 0.2 |
| $Fe^{3+}$ *producing* rate (mg/min.) | 183 | 250 | 10 | 417 | 521 | 708 | 63 | 393 |
| Electrolysis efficiency (%) | 58 | 80 | 100 | 67 | 42 | 37 | 100 | 62 |

TABLE 3

| | Electrolytic Conditions and Results Example (2/2) | | | | | |
|---|---|---|---|---|---|---|
| Sample No. | 9 | 10 | 11 | 12 | 13 | 14 |
| Agents | D | E | A | A | A | A |
| Conditions | | | | | | |
| Cur. density (A/dm$^2$) | 20 | 25 | 5 | 5 | 0.05 | 40 |
| Flow rate (1/min · dm$^2$) | 3 | 5 | 10 | 0.05 | 1 | 1 |
| Iron density in anolyte (g/l) | 4.0 | 1.5 | 1.5 | 1.5 | 1.5 | 1.5 |
| $Fe^{3+}$ *producing* rate (mg/min.) | 589 | 642 | 190 | 62 | 3 | 735 |
| Electrolysis efficiency (%) | 47 | 41 | 61 | 19 | 100 | 29 |

The $Fe^{3+}$ producing rate is calculated by the formula: amount of produced $Fe^{3+}$/electrolysis time (minute).

The electrolysis efficiency is calculated by $100 \times F \times V / I \times T$, where F is a Faraday constant, C: concentration of $Fe^{3+}$ (mole/liter), V: volume (l), I: current (A), and T: electrolysis time.

Table 4 shows a comparison sample which was regenerated by operating a pump without the electrolysis process.

TABLE 4

| Sample No. | 1 |
|---|---|
| Agent | A |
| Conditions | |
| Current (A/dm$^2$) | — |
| Flow rate (1/min. dm$^2$) | 1 |
| Iron density in anolyte (g/l) | 1.5 |
| $Fe^3$ producing rate (mg/minute) | 0 |
| Electrolysis efficiency (%) | 1 |

As can be seen from Tables 1 to 3, it is confirmed that ferric ions are produced by electrolytical oxidation and that the concentration of iron ions in all the anolytes (cleaning agents) are kept in the range of 0.2 to 4 g/l in the samples 1 to 14.

In the example 2 shown in Table 2, a current is supplied to an electrolytic bath 30 from a DC power source 32 so as to execute electrolysis between an anode 33 and a cathode 34, thereby oxidizing $Fe^{2+}$. A cleaning bath 40 supplies a cleaning agent to an anode chamber 30*a* in the electrolytic bath 30 via a pump 35. A catholyte bath 37 supplies water-soluble sulfuric acid to a cathode chamber 30*b* via a pump 36. The electrolytic bath 30 has a partition at the center thereof to separate the anolyte and catholyte. In the second example, an oxidation-reduction potentiometer (ORP) 50 is used to monitor an oxidation-reduction potential of the cleaning agent in the bath 40 so that the oxidation-reduction potential can be maintained constant by controlling the current from the power source 32. This arrangement is very effective to maintain the constant concentration of $Fe^{3+}$ ions by observing the oxidation-reduction potential in the cleaning bath 40.

What is claimed is:

1. A method of regenerating a cleaning agent used for cleaning an aluminum surface in a cleaning bath, comprising:

(a) supplying the cleaning agent to an electrolytic tank, said cleaning agent including ferrous ions reduced during the cleaning of the aluminum surface;

(b) oxidizing the ferrous ions electrolytically into ferric ions; and (c) returning the cleaning agent containing the ferric ions to the cleaning bath from the electrolytic tank, wherein the cleaning agent contains 0.2–4 g/l ferric ions and the cleaning agent is regulated to have a pH value of 0.6–2.0, wherein sulfuric acid or nitric acid is added to the cleaning agent to regulate the pH value thereof.

2. A method according to claim 1, wherein the sulfuric acid is added to the cleaning agent to regulate the pH value thereof.

3. A method according to claim 1 further includes a step of replenishing iron ions.

4. A method according to claim 3, wherein the iron ions are supplied by ferric sulfate so as to replenish ferric ions and sulfuric ions.

5. A method according to claim 4, wherein the amount of the cleaning agent supplied to the electrolytic tank is 0.1–5 liters/min.dm$^2$ per effective electrode area, and a current density for the electrolytic oxidation is 0.1–30A/dm$^2$.

6. A method according to claim 1, wherein a concentration of the ferric ions in the cleaning agent is measured to control intensity of the electrolytic oxidation.

7. A method according to claim 6, wherein the concentration of the ferric ions is observed by measuring an oxidation-reduction potential of the cleaning agent.

8. A method according to claim 1 wherein the cleaning agent further contains 0.1 to 10 g/l of a surface active agent.

* * * * *